United States Patent [19]

Haswell, Jr. et al.

[11] Patent Number: 4,769,213

[45] Date of Patent: Sep. 6, 1988

[54] AGE-HARDENABLE STAINLESS STEEL HAVING IMPROVED MACHINABILITY

[75] Inventors: Walter T. Haswell, Jr., Jamesville, N.Y.; Kenneth E. Pinnow, Pittsburgh, Pa.; Geoffrey O. Rhodes, Saxonburg, Pa.; John J. Eckenrod, Coraopolis, Pa.

[73] Assignee: Crucible Materials Corporation, Pittsburgh, Pa.

[21] Appl. No.: 898,487

[22] Filed: Aug. 21, 1986

[51] Int. Cl.[4] ..... C22C 38/20

[52] U.S. Cl. ..... 420/61; 420/58; 420/60

[58] Field of Search ..... 420/42, 60, 58, 61; 148/325, 326

[56] References Cited

U.S. PATENT DOCUMENTS

| | | | |
|---|---|---|---|
| 2,482,097 | 9/1949 | Clarke | 148/326 |
| 2,797,993 | 7/1957 | Tanczyn | 148/326 |
| 4,613,367 | 9/1985 | Eckenrod et al. | 420/44 |

FOREIGN PATENT DOCUMENTS

| | | | |
|---|---|---|---|
| 48-27569 | 8/1973 | Japan | 420/61 |
| 56-127754 | 10/1981 | Japan | 420/60 |
| 1061563 | 3/1967 | United Kingdom | 420/60 |

OTHER PUBLICATIONS

U.S. Ser. No. 898,488 filed 8-21-86 by Eckenrod et al.
U.S. Ser. No. 910,239 filed 9-19-86 by Haswell et al.
U.S. Ser. No. 910,238 filed 9-19-86 by Eckenrod et al.

*Primary Examiner*—Deborah Yee
*Attorney, Agent, or Firm*—Finnegan, Henderson, Farabow, Garrett & Dunner

[57] ABSTRACT

A chromium-nickel-copper, age-hardenable martensitic stainless steel having improved machinability in the solution-treated and also in the age-hardened condition. The steel has carbon plus nitrogen up to 0.08%, preferably 0.05 or 0.035% for purposes of improved machinability.

12 Claims, No Drawings

AGE-HARDENABLE STAINLESS STEEL HAVING IMPROVED MACHINABILITY

BACKGROUND OF THE INVENTION

Age-hardenable martensitic stainless steels of the compositions disclosed in U.S. Pat. Nos. 2,482,096 and 2,850,380 have very useful combinations of mechanical properties and corrosion resistance. For many applications, steels of this type are machined in the solution-treated condition and then subsequently hardened by a simple age-hardening treatment at temperatures between about 850° and 1150° F. The primary advantage of this procedure is that components and articles can be machined close to final dimensions and then subsequently hardened without encountering excessive scaling, large changes in dimensions, or difficulty in heat treatment. However, the machinability of these present age-hardening stainless steels is marginal, particularly in the solution-treated condition, and often special and costly procedures are required with them to obtain reasonable machining rates and cutting-tool life in commercial applications.

To obtain the desired fully martensitic structure in the solution-treated condition, the chemical composition of the age-hardening stainless steels must be closely controlled to minimize or eliminate delta ferrite and to control the austenite transformation characteristics. This requires a close balance between the austenite forming elements, such as carbon, nitrogen, manganese, nickel, and copper; and the ferrite forming elements, such as chromium, molybdenum, silicon, and columbium, to control the ferrite content; and of the overall composition to control the stability of the austenite formed at higher temperatures during solution-treating.

As described in U.S. Pat. Nos. 2,850,380 and 3,574,601, it is known that the machinability of the age-hardening martensitic stainless steels can be improved by increasing the sulfur content of the steels, or by adding other elements such as selenium, tellurium, bismuth or lead, which like sulfur can improve machinability. However, sulfur and these other elements have an adverse effect on hot workability and on the mechanical properties and corrosion resistance of many product forms. In bar products, for example, the sulfides produced by the sulfur additions elongate in the direction of hot rolling, producing sulfide stringers which markedly reduce transverse impact strength and ductility, and overall mechanical properties. Also, the marked tendency of sulfur to segregate in large, conventionally cast ingot sections has a marked detrimental effect on the soundness, polishability, and texturizing properties of plastic molds produced from these materials. Therefore, with prior art steels of this type, sulfur is desirably included from the standpoint of enhancing machinability, but only at a significant sacrifice of toughness, ductility, corrosion resistance, polishability, texturizing, and other related properties.

OBJECTS OF THE INVENTION

It is accordingly a primary object of the present invention to provide a chromium-nickel-copper, age-hardenable martensitic stainless steel characterized by improved machinability, particularly in the solution-treated and also in the age-hardened conditions.

An additional object of the invention is to provide a stainless steel of this type having improved machinability, particularly in the solution-treated and also in the age-hardened conditions without requiring the presence of significant sulfur or other free-machining additives for this purpose.

Another object of this invention is to provide a sulfur-bearing stainless steel of this type with improved machinability, particularly in the solution-treated and also in the age-hardened conditions.

Another object of this invention is to provide a stainless steel mold of this type steel for molding plastics and other materials with improved machinability, particularly in the solution-treated and also in the age-hardened conditions.

Yet another object of this invention is to provide a sulfur-bearing stainless steel mold of this type steel for molding plastics and other materials with improved machinability, particularly in the solution-treated and also in the age-hardened conditions.

SUMMARY OF THE INVENTION

In accordance with this invention, it has now been discovered that the machinability of the chromium-nickel-copper, age-hardenable martensitic stainless steels can be greatly improved, particularly in the solution-treated and also in the age-hardened conditions, by reducing their carbon plus nitrogen contents below customary levels. In this regard, carbon plus nitrogen in combination at low levels in accordance with the invention is more effective than low carbon or nitrogen alone. Along with the reductions in carbon plus nitrogen content, the overall composition of the steels of this invention must be balanced to minimize or avoid the formation of delta ferrite and to assure that a fully martensitic structure is obtained in the solution-treated condition. The improvements in machinability obtained by reducing carbon plus nitrogen content are produced both at very low and at elevated sulfur contents, making it possible to improve machinability without increasing sulfur content; or to further improve the machinability of sulfur-bearing materials used in applications where the detrimental effects of sulfur on mechanical properties, corrosion resistance, and other properties can be tolerated.

In accordance with the invention there is provided a chromium-nickel-copper, age-hardenable martensitic stainless steel characterized by having improved machinability in both the solution-treated and age-hardened conditions. The steel consists essentially of, in weight percent:

carbon plus nitrogen up to 0.08, or preferably 0.05, or 0.035;
manganese up to 8.0; or preferably 2.0;
phosphorus up to 0.040;
sulfur up to 0.15; or preferably 0.030;
silicon up to 1.0;
nickel 2.00 to 5.50, or for molds preferably 2.5 to 3.5;
chromium 11.00 to 17.50, or for molds preferably 11 to 13;
molybdenum up to 3; or preferably 0.50;
copper 2.00 to 5.00;
columbium up to 15 x (C+N);
aluminum up to 0.05; and
balance iron with incidental impurities.

The steels of the invention may optionally have up to 0.5% beryllium.

The composition is balanced to have essentially no delta ferrite and an $M_s$ temperature above 250° F. The $M_s$ temperature is the temperature at which transformation to martensite begins on cooling. By maintaining the $M_S$ temperature above 250° F., it is assured that essentially complete transformation to martensite is achieved at or above room temperature.

The steels of the invention are essentially ferrite free according to:

$$\% \text{ Ferrite} = -117.8 - 151.3\,(C + N) + 9.7\,(Si) - 7.7\left(Ni + \frac{Mn}{2} + \frac{Cu}{3}\right) + 9.1\,(Cr) + 7.3(Mo) + 32.4\,(Cb). \quad \text{Equation (1)}$$

The steels of the invention are essentially fully martensitic upon cooling from the solution-treating temperature to or below ambient temperature according to:

$$M_S(°F.) = 2280 - 2620\left(C + N - \frac{Cb}{8}\right) - 102\,(Ni + 2\,Mn) - 66\,(Cr + Mo) - 97\,(Cu) \quad \text{Equation (2)}$$

In these equations, manganese is substituted for nickel on the basis of 1% manganese for each 0.5% nickel.

The steels of the invention find particular advantage in the manufacture of plastic molds. The molds may be machined prior to hardening treatment, which provides for economical production. Also, the steels of the invention for mold manufacture will be characterized by only slight dimensional change during age-hardening to minimize final machining and polishing. With sulfur being at relatively low levels the adverse effect of sulfur with respect to segregation in mold applications is avoided. For mold applications where corrosion resistance does not require the higher chromium contents of the steels of the invention, chromium may be limited to 11.00 to 13.00%. Accordingly, nickel may likewise be limited to 2.5 to 3.5% for balancing with chromium to achieve the required microstructural balance.

Columbium may be used in the steels of the invention to stabilize carbon plus nitrogen and thus may be present in an amount relating to the carbon plus nitrogen content of the steel. Although titanium is an element conventionally used for this purpose as an equivalent for columbium, it cannot be used as a substitute for columbium in the steels of this invention without using special steel refining practices. In these steels, the presence of titanium in significant amounts results in the presence of titanium carbo-nitrides and oxides which adversely affect machinability.

DETAILED DESCRIPTION OF THE INVENTION AND SPECIFIC EXAMPLES

To demonstrate the principle of this invention, several heats were melted for machinability testing. The chemical compositions, and calculated percent delta ferrite and martensite start temperatures on cooling from the solution-treating temperature for these heats are given in Table 1.

TABLE I

Chemical Composition, Calculated Percent Ferrite and Calculated Martensite Start Temperature (Ms) of Age Hardenable Stainless Steels

| | Weight Percent | | | | | | | | | | | | | Percent | $M_S$ |
|---|---|---|---|---|---|---|---|---|---|---|---|---|---|---|---|
| Heat | C | Mn | P | S | Si | Ni | Cr | Mo | Cu | Cb | B | N | C + N | Ferrite(1) | (°F.)(2) |
| V547 | 0.050 | 0.51 | 0.025 | 0.011 | 0.47 | 4.28 | 15.43 | 0.27 | 3.15 | 0.28 | 0.003 | 0.046 | 0.096 | 0 | 236 |
| V551A | 0.043 | 0.55 | 0.035 | 0.036 | 0.50 | 4.32 | 15.37 | 0.26 | 3.09 | 0.29 | 0.003 | 0.048 | 0.091 | 0 | 251 |
| V551 | 0.040 | 0.52 | 0.022 | 0.035 | 0.44 | 4.29 | 15.55 | 0.27 | 3.12 | 0.29 | 0.003 | 0.043 | 0.083 | 0 | 266 |
| V593 | 0.017 | 0.49 | 0.028 | 0.024 | 0.48 | 4.37 | 15.33 | 0.26 | 3.06 | 0.29 | 0.004 | 0.056 | 0.073 | 0 | 310 |
| V594 | 0.039 | 0.49 | 0.026 | 0.024 | 0.47 | 4.48 | 15.52 | 0.26 | 3.07 | 0.20 | 0.004 | 0.018 | 0.057 | 0 | 300 |
| V552A | 0.023 | 0.50 | 0.035 | 0.014 | 0.50 | 4.73 | 15.57 | 0.26 | 3.07 | 0.20 | 0.003 | 0.027 | 0.050 | 0 | 286 |
| V592 | 0.017 | 0.49 | 0.023 | 0.025 | 0.47 | 4.51 | 15.64 | 0.26 | 3.05 | 0.19 | 0.004 | 0.029 | 0.046 | 0 | 316 |
| V552 | 0.021 | 0.52 | 0.024 | 0.017 | 0.46 | 4.81 | 15.52 | 0.27 | 3.16 | 0.21 | 0.002 | 0.013 | 0.034 | 0 | 313 |
| V554 | 0.022 | 0.51 | 0.024 | 0.030 | 0.43 | 4.85 | 15.48 | 0.27 | 3.16 | 0.20 | 0.002 | 0.013 | 0.035 | 0 | 307 |

(1) $\% \text{ Ferrite} = -117.8 - 151.3\,(C + N) + 9.7\,(Si) - 7.7\left(Ni + \frac{Mn}{2} + \frac{Cu}{3}\right) + 9.1\,(Cr) + 7.3\,(Mo) + 32.9\,(Cb)$ (2) $M_S(°F.) = 2280 - 2620\,(C + N - Cb/8) - 102\,(Ni + 2\,Mn) - 66\,(Cr + Mo) - 97\,(Cu)$.

Heat V547 has a typical chemical composition for an age-hardenable stainless steel of this type. The other eight heats were melted to establish the effects of carbon, nitrogen, and sulfur on the machinability of solution-treated and age-hardened stainless steels of the present invention. To maintain similar austenite-ferrite balance and transformation characteristics among these heats, the nickel contents of the steels containing less than 0.06% carbon plus nitrogen and 0.21% columbium were increased slightly. All of the steels are essentially ferrite-free according to Equation (1) and fully martensitic according to Equation (2) when cooled from the solution-treating temperature to or slightly below ambient temperature.

$$\% \text{ Ferrite} = -117.8 - 151.3\,(C + N) + 9.7\,(Si) - 7.7\left(Ni + \frac{Mn}{2} + \frac{Cu}{3}\right) + 9.1\,(Cr) + 7.3(Mo) + 32.4\,(Cb) \quad \text{Equation (1)}$$

$$M_S(°F.) = 2280 - 2620\left(C + N - \frac{Cb}{8}\right) - 102\,(Ni + 2\,Mn) - 66\,(Cr + Mo) - 97\,(Cu) \quad \text{Equation (2)}$$

The 50-pound heats of Table I were induction melted and teemed into cast iron molds. After forging to 1¼-inch octagon bars from a temperature of 2150° F., the bars were air cooled to ambient temperature; solution-treated at 1900° F. for ½ hour; and then oil quenched. Four-inch long samples from these bars, with the exception of those from Heats V592, V593 and V594, were aged at 1150° F. for four hours and air cooled. Similar samples were heated at 1400° F. for two hours, air cooled to ambient temperature, then reheated at 1150° F. for four hours and air cooled.

TABLE II

Drill Machinability of Age-Hardenable Stainless Steels

| Heat | Composition (%) C + N | Composition (%) S | Drill Machinability Rating[a] Solution-Treated | Aging Temperature (°F.) 1150 | Aging Temperature (°F.) 1400 Plus 1150 |
|---|---|---|---|---|---|
| V547 | 0.096 | 0.011 | 100 | 129 | 158 |
| V551A | 0.091 | 0.036 | 115 | 131 | 163 |
| V551 | 0.083 | 0.035 | 122 | 135 | 167 |
| V593 | 0.073 | 0.024 | 119 | — | — |
| V594 | 0.057 | 0.024 | 132 | — | — |
| V552A | 0.050 | 0.014 | 128 | — | 162 |
| V592 | 0.046 | 0.025 | 136 | — | — |
| V552 | 0.034 | 0.017 | 141 | 135 | 165 |
| V554 | 0.035 | 0.030 | 144 | 141 | 170 |

[a]Drill Machinability Rating = $\frac{\text{Total Drill Time Standard}}{\text{Total Drill Time Test}} \times 100$ (Heat V547 was chosen as standard age-hardenable stainless steel)

Solution-treated, 1150° F. and 1400 plus 1150° F. were drill tested separately, however, Heat V547 in the solution-treated condition was used to calculate DMR in all 3 conditions.

Load: 32.2 lb

Speed: 210 rpm 0.3-inch timed hole depth

¼-inch new high speed steel jobber bits

Drill machinability testing was conducted on 4-inch long parallel ground bar sections from all nine heats in the solution-treated condition, and also in the 1150° F. and the 1400° F. plus 1150° F. aged conditions, with the exception of Heats V592, V593 and V594. The drill machinability rating (DMR) data are given in Table II. As may be seen from these data, the 1400° F. plus 1150° F. aged condition provides the best machinability and the solution-treated condition the poorest. It may be seen that in each of the three conditions the machinability, as indicated by the drill machinability rating, improves as the carbon plus nitrogen contents are decreased. The most dramatic improvement, however, is obtained with the steels in the solution-treated condition.

Consider Heats V547, V552A and V552, all having similar sulfur contents. In accordance with the invention, lowering the carbon plus nitrogen content from a typical level of 0.096% in Heat V547 to 0.050% in Heat V552A results in about a 28% improvement in machinability in the solution-treated condition. Lowering the carbon plus nitrogen still further to 0.034% results in a 41% improvement in machinability. Similar increments in machinability improvement result from lowering the carbon plus nitrogen content of the higher sulfur steels V551, V551A, and V554. The known effect of increased sulfur in improving machinability is demonstrated by comparing Heats V547 (0.011% S) and V551A (0.036% S). Thus, in accordance with this invention, machinability is improved by controlling carbon plus nitrogen at low levels with the steels in either the solution-treated or the age-hardened conditions.

To further demonstrate the invention, lathe cut-off-tool life tests were conducted on one-inch round, solution-treated bars turned from the 1¼ inch octagonal bars with the exception of those from Heats V592, V593 and V594. In the lathe cutoff-tool life test, the number of wafers cut from the steel before catastrophic tool failure occurs at various machining speeds is used as a measure of machinability. The greater the number of wafers that can be cut at a given machining speed, the better the machinability of the steel. The specific conditions used in these tests were as follows: solution-treated one inch round bars; the cut-off tools were ¼ inch flat AISI M2 high speed steel; the tool geometry was 0° top rake angle, 14° front clearance angle, 3° side clearance angle, 0° cutting angle; the feed rate was 0.002 inches per revolution; and a 2 parts dark thread-cutting oil mixed with 3 parts of kerosene was used as a lubricant. Machining speeds were from 100 to 180 surface feet per minute. The test results are listed in Table III. As may be seen from the data presented in Table III for the lower sulfur materials, Heats V552A (0.05% carbon plus nitrogen) and V552 (0.034% carbon plus nitrogen) in general exhibit better machinability, i.e., more wafer cuts at higher machining speeds, than does Heat V547 (0.096% carbon plus nitrogen). Similar results were obtained for the higher sulfur heats V551A (0.091% carbon plus nitrogen) and V554 (0.035% carbon plus nitrogen).

TABLE III

Lathe Tool-Life Test Results on Solution-Treated Age-Hardenable Stainless Steels

| Heat No. | Composition % C + N | Composition % S | Average Number of Wafer Cuts at Indicated Machining Speed - Surface Feet Per Minute (sfm) 180 | 170 | 165 | 160 | 155 | 150 | 145 | 140 | 135 | 130 | 125 | 120 | 115 | 110 | 100 |
|---|---|---|---|---|---|---|---|---|---|---|---|---|---|---|---|---|---|
| V547 | 0.096 | 0.011 | — | — | — | — | — | — | — | — | — | 2 | — | 3.25 | — | 8.75 | 24 |
| V551A | 0.091 | 0.036 | — | — | — | — | — | — | — | — | — | 2.5 | 6.25 | 13.75 | 36 | — | — |
| V551 | 0.083 | 0.035 | — | — | — | — | — | — | — | — | 2.5 | 4.75 | 9.5 | 21.25 | 39 | — | — |
| V552A | 0.050 | 0.014 | — | — | — | 2 | — | 4.5 | — | 8.5 | 24.3 | — | — | — | — | — | — |
| V552 | 0.034 | 0.017 | — | — | 4 | 7 | 10 | 24 | 42 | — | — | — | — | — | — | — | — |
| V554 | 0.035 | 0.030 | 5 | 8.5 | — | 15 | — | 26 | 34.75 | — | — | — | — | — | — | — | — |

Due to the wide variation in machining speeds used to evaluate these materials, a constant tool life criterion was developed to directly compare all six heats. The machinability data for these heats were analyzed by linear regression methods, and the machining speeds necessary to obtain 10, 20, 30 and 40 wafer cuts calculated. The calculated results are given in Table IV. As may be seen from Table IV, lowering the carbon plus nitrogen content of the invention steels at both low and high sulfur contents results in significantly increased machining speeds, indicative of improved machinability; higher-sulfur steel also provides improved machinability.

TABLE IV

Constant Tool Life Machining Speeds for Solution-Treated Age-Hardenable Stainless Steels

| | Heat Number | Composition % C + N | Composition % S | Constant Tool-Life (Wafer Cuts) $V_{10}$* | $V_{20}$* | $V_{30}$* | $V_{40}$* |
|---|---|---|---|---|---|---|---|
| Low Sulfur | V547 | 0.096 | 0.011 | 109 | 101 | 97 | 95 |
| | V552A | 0.050 | 0.014 | 142 | 135 | 131 | 129 |
| | V552 | 0.034 | 0.017 | 157 | 151 | 148 | 145 |
| High Sulfur | V551A | 0.091 | 0.036 | 122 | 118 | 116 | 114 |
| | V551 | 0.083 | 0.035 | 125 | 120 | 117 | 115 |
| | V554 | 0.035 | 0.030 | 167 | 155 | 148 | 143 |

*(sfm) = surface feet per minute.

The linear regression equations developed from the cut-off-tool life test data were as follows:

$$V(10) = 177-789\ (\%C+\%N)+449\ (\%S)$$

$$V(20) = 167-734\ (\%C+\%N)+459\ (\%S)$$

$$V(30) = 161-703\ (\%C+\%N)+462\ (\%S)$$

$$V(40) = 157-682\ (\%C+\%N)+468\ (\%S)$$

where V (10), V (20), V (30) and V (40) are the machining speeds required to produce 10, 20, 30 and 40 wafer cuts, respectively. As can be seen from the equations, on an equivalent weight-percent basis, lowering the carbon and nitrogen content of the invented steels is from 1.5 to 1.75 times more effective in improving machinability than is increasing the sulfur content. Thus, significantly better machinability can be obtained by reducing the carbon plus nitrogen content of the invention steels than by increasing the sulfur content. The latter effect is particularly important in mold steels where a lower sulfur content results in fewer sulfide inclusions and better polishability. As indicated by the positive nature of the regression coefficient for sulfur, higher sulfur contents would further improve machinability. Thus, the combination of low carbon plus nitrogen content along with high sulfur content results in substantially improved machinability, which would be useful in applications where somewhat degraded toughness, corrosion resistance, or polishability can be tolerated.

It has also been discovered that chromium-nickel-copper age-hardenable martensitic steels within the scope of this invention have significantly improved resistance to chloride stress corrosion cracking. To illustrate this advantage, strip samples were prepared from Heats V547 and V551A, which have carbon plus nitrogen contents of 0.096 and 0.091%, respectively, and from Heats V552 and V554, which have carbon plus nitrogen contents of 0.034 and 0.035%, respectively, and subjected to bent beam tests in boiling 45% magnesium chloride, a test environment often used to evaluate the susceptibility of stainless steels to stress corrosion cracking. Before they were tested, the strip samples were solution-treated at 1900° F. for 15 minutes, plate quenched to room temperature, and then age-hardened at 1150° F. for four hours. The specimens during testing were loaded to 110,000 psi or about 90% of the typical yield strength of these steels when age-hardened at 1150° F. The bent beam test specimens from Heats V547 and V551A, having carbon plus nitrogen contents outside the scope of the invention, cracked between one and two hours, and between two and three hours of test exposure, respectively. In marked contrast, the bent beam test specimens from Heat V552 and V554, having carbon plus nitrogen contents within the scope of the invention, did not crack after 42 hours of exposure. Thus, in applications where high resistance to chloride stress corrosion is essential, the steels of this invention have definite advantages over prior art steels of this type.

To obtain the desired mechanical properties, heat treatment response, machinability, and corrosion resistance the chemical composition of the steels of this invention must be balanced according to equation (1) so that they contain essentially no delta ferrite and according to equation (2) so that the martensite start temperature is above about 250° F. Also, some further restrictions of their chemical compositions are essential to maintain their good hot workability, heat treatment response, and other properties. Aluminum, a well known additive to stainless steels to provide age-hardening response, should not be added to the steels of the invention unless special expensive melting and refining techniques are used to make the steel. Aluminum additions to age-hardenable stainless steel made by conventional melting and refining techniques result in the formation of hard angular nonmetallic inclusions in the steel which degrade machinability by increasing tool wear. Also, the normal clustering tendencies for aluminum containing inclusions could also be detrimental. Thus, the aluminum content of the invention steels must be restricted below about 0.05%, unless additional refining steps such as vacuum melting are used. To supplement the age-hardening response of the invention steels, beryllium may be added in amounts up to about 0.50%. Further, to improve the hot workability of the invention steels, boron may be added in amounts up to 0.01%.

What is claimed is:

1. A chromium-nickel-copper, age-hardenable martensitic stainless steel characterized by having improved machinability in both the solution-treated and age-hardened conditions and stress corrosion cracking resistance after aging, said steel consisting essentially of, in weight percent:

carbon plus nitrogen up to 0.05
manganese up to 8.0
phosphorus up to 0.040
sulfur up to 0.15
silicon up to 1.0
nickel 2.00 to 5.50
chromium 11.00 to 17.50
molybdenum up to 3.0
copper 2.00 to 5.00
columbium 0.19% to 15 x (C+N)
aluminum up to 0.05
balance iron with incidental impurities, with the composition of said steel being balanced to have both no delta ferrite according to equation (1) and an $M_s$ temperature above 250° F. according to equation (2).

2. The steel of claim 1 having up to 0.030 sulfur.

3. A chromium-nickel-copper, age-hardenable martensitic stainless steel characterized by having improved machinability in both the solution-treated and age-hardened conditions and stress corrosion cracking resistance after aging, said steel consisting essentially of, in weight percent:

carbon plus nitrogen up to 0.05
manganese up to 2.0
phosphorus up to 0.040
sulfur up to 0.15
silicon up to 1.0
nickel 2.00 to 5.50
chromium 11.00 to 17.50
molybdenum up to 0.50
copper 2.00 to 5.00
columbium 0.19% to 15 x (C+N)
aluminum up to 0.05
balance iron with incidental impurities, with the composition of said steel being balanced to have both no delta ferrite according to equation (1) and an $M_s$ temperature above 250° F. according to equation (2).

4. The steel of claim 3 having up to 0.030 sulfur.

5. A chromium-nickel-copper, age-hardenable martensitic stainless steel mold characterized by having improved machinability in both the solution-treated and age-hardened conditions and stress corrosion cracking resistance after aging, said mold consisting essentially of, in weight percent:

carbon plus nitrogen up to 0.05
manganese up to 8.0
phosphorus up to 0.040
sulfur up to 0.15
silicon up to 1.0
nickel 2.00 to 5.50
chromium 11.00 to 17.50
molybdenum up to 3.0
copper 2.00 to 5.00
columbium 0.19% to 15 x (C+N)
aluminum up to 0.05
balance iron with incidental impurities, with the composition of said mold being balanced to have both no delta ferrite according to equation (1) and an $M_s$ temperature above 250° F. according to equation (2).

6. The steel mold of claim 5 having up to 0.030 sulfur.

7. A chromium-nickel-copper, age-hardenable martensitic stainless steel mold characterized by having improved machinability in both the solution-treated and age-hardened conditions and stress corrosion cracking resistance after aging, consisting essentially of, in weight percent:

carbon plus nitrogen up to 0.05
manganese up to 2.0
phosphorus up to 0.040
sulfur up to 0.15
silicon up to 1.0
nickel 2.00 to 5.50
chromium 11.00 to 17.50
molybdenum up to 0.50
copper 2.00 to 5.00
columbium 0.19% to 15 x (C+N)
aluminum up to 0.05
balance iron with incidental impurities, with the composition of said mold being balanced to have both no delta ferrite according to equation (1) and an $M_s$ temperature above 250° F. according to equation (2).

8. The steel mold of claim 7 having up to 0.030 sulfur.

9. The steel of claims 1, or 2, or 3, or 4 having up to 0.5 beryllium.

10. The steel mold of claims 5, or 6, or 7, or 8 having up to 0.5 beryllium.

11. The steel mold of claim 7 having 2.50 to 3.50 nickel and 11.00 to 13.00 chromium.

12. The steel mold of claim 11 having up to 0.030 sulfur.

* * * * *